US007291982B2

(12) United States Patent
Longhino et al.

(10) Patent No.: US 7,291,982 B2
(45) Date of Patent: Nov. 6, 2007

(54) METHOD AND APPARATUS FOR THE CLOSED LOOP AND OPEN LOOP CONTROL OF FILAMENT HEATING FOR LAMPS

(75) Inventors: Werner Longhino, Mehring (DE); Andreas Mitze, Traunreut (DE); Thomas Mudra, Kastl (DE)

(73) Assignee: Patent-Treuhand-Gesellschaft fur Elektrisch Gluhlampen mbH, Munich (DE)

( * ) Notice: Subject to any disclaimer, the term of this patent is extended or adjusted under 35 U.S.C. 154(b) by 0 days.

(21) Appl. No.: 11/337,608

(22) Filed: Jan. 24, 2006

(65) Prior Publication Data

US 2006/0164019 A1 Jul. 27, 2006

(30) Foreign Application Priority Data

Jan. 25, 2005 (DE) ..... 10 2005 003 450

(51) Int. Cl.
*H01J 7/24* (2006.01)
*G05F 1/00* (2006.01)

(52) U.S. Cl. ..... 315/117; 315/309

(58) Field of Classification Search ..... 315/209 R, 315/224, 291, 307, DIG. 4, DIG. 2, 64, 69, 315/113, 117, 308, 309
See application file for complete search history.

(56) References Cited

U.S. PATENT DOCUMENTS 5,798,614 A 8/1998 Bishop
6,107,750 A * 8/2000 Moisin ..... 315/219
6,140,772 A * 10/2000 Bishop ..... 315/106
6,252,357 B1 * 6/2001 Tanaka et al. ..... 315/209 R
6,580,229 B2 * 6/2003 Murakami et al. ..... 315/224
6,605,908 B1 * 8/2003 Zhang et al. ..... 315/307
2002/0145886 A1 10/2002 Stevens

FOREIGN PATENT DOCUMENTS

DE 19850441 A1 10/1998

OTHER PUBLICATIONS

European Search Report dated May 17, 2006 from corresponding EP Application No. 06000746.5, 6 pages.

* cited by examiner

*Primary Examiner*—Shih-Chao Chen
*Assistant Examiner*—Minh Dieu A
(74) *Attorney, Agent, or Firm*—Carlo Bessone

(57) ABSTRACT

An apparatus for the closed-loop and open-loop control of filament heating for a lamp, in particular for a fluorescent lamp, has a control loop into which a first filament (W1), an operational-parameter detection element (E), a heating controller (H) and a first actuating element (S1) are connected. The heating poser of the first filament (W1) is detected by means of the operational-parameter detection element (E) and, on the basis of this, a manipulated variable (SG) is determined, by means of which this first filament (W1) is subjected to closed-loop control. Furthermore, at least one second filament (W2 to Wn), which is not connected in the control loop, is controlled on the basis of the determined manipulated variable (SG).

6 Claims, 1 Drawing Sheet

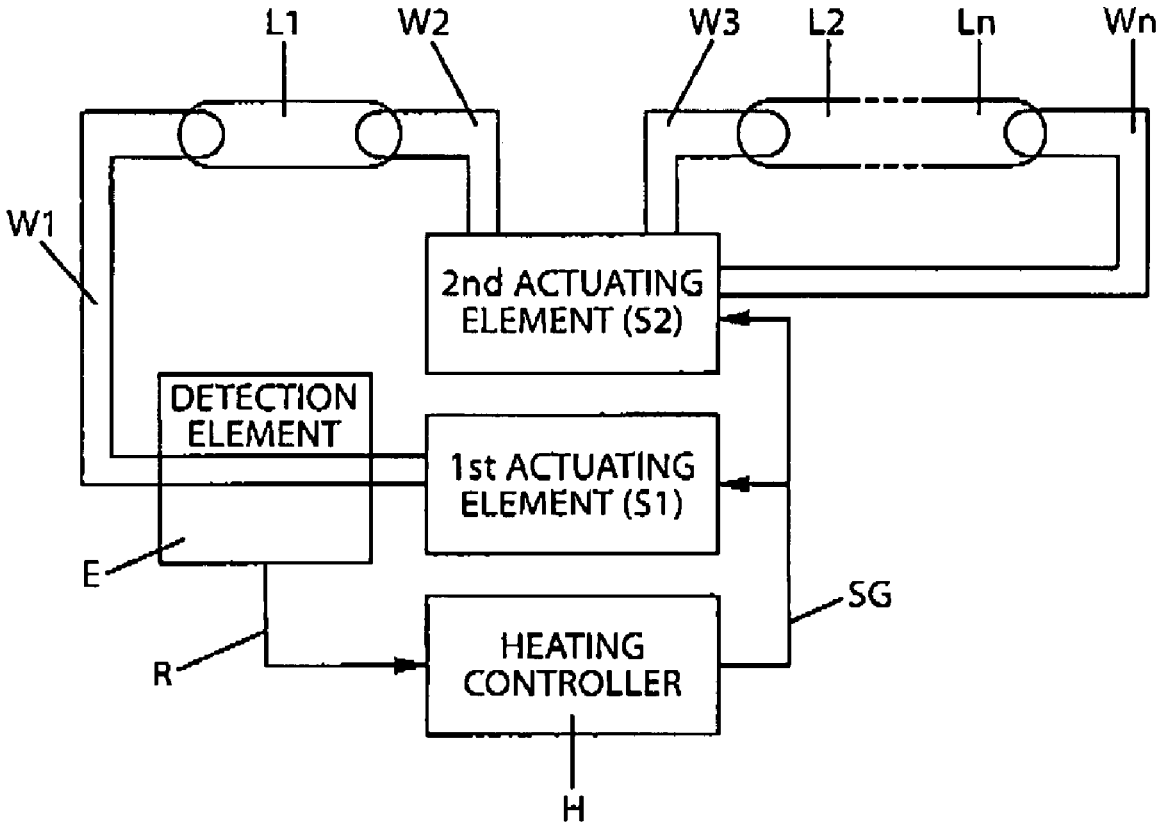
L1
W2
W3
L2
Ln
Wn
W1
2nd ACTUATING ELEMENT (S2)
DETECTION ELEMENT
1st ACTUATING ELEMENT (S1)
E
SG
R
HEATING CONTROLLER
H

METHOD AND APPARATUS FOR THE CLOSED LOOP AND OPEN LOOP CONTROL OF FILAMENT HEATING FOR LAMPS

FIELD OF THE INVENTION

The invention relates to a method and an apparatus for the closed-loop and open-loop control of filament heating for lamps, in particular fluorescent lamps.

BACKGROUND OF THE INVENTION

It is necessary to use filament heating systems for lamps, in particular fluorescent lamps. In the case of known filament heating systems, it is conventional for them not to be subjected to closed-loop control. In particular in the case of dimmable fluorescent lamps, there is a reduction in the discharge current in an operation in which the light from the lamps is reduced by means of a dimmer. This results in the heating of the filaments likewise being reduced, and it therefore being necessary to carry out additional heating externally. In the case of the known filament heating systems, it is therefore necessary for dedicated ballasts to have been developed, depending on the number of lamps to be operated, since the additional heating was dependent on the number of lamps.

SUMMARY OF THE INVENTION

It is therefore the object of the invention to provide a method and an apparatus in which the additional heating of filaments can be carried out with little complexity.

A method according to the invention is designed for the closed-loop and open-loop control of filament heating for lamps. In particular the filament heating for fluorescent lamps may be subjected to closed-loop and open-loop control using the method according to the invention. In a first step, an operational parameter of at least one first filament is detected. This first filament is arranged in a control loop. In a further step, a manipulated variable is determined on the basis of the detected operational parameter. The first filament is subjected to closed-loop control on the basis of this manipulated variable. Furthermore, an at least second filament is subjected to open-loop control on the basis of this manipulated variable, the second filament being arranged outside the control loop. The method according to the invention makes it possible to realize additional heating of filaments for lamps, in particular fluorescent lamps, with little complexity. It is thus possible for an operational parameter to be detected of only a single filament and for a manipulated variable to be determined from the obtained information of the operational parameter, and this manipulated variable is used, firstly, for the closed-loop control of the first filament and for the open-loop control of a further filament by means of this manipulated variable. For the additional heating, it is thus necessary for information relating to the heating behavior of only one filament to be obtained from this filament in order to be able to carry out a corresponding change to the additional heating of the two filaments with little complexity. All of the filaments are thus always operated optimally.

The detection of the operational parameter and the determination of the manipulated variable are advantageously carried out independently of the number of filaments and of lamps which are electrically connected to the filaments. The additional heating of the filaments, in particular the additional heating of the filaments which is subjected to closed-loop control, is independent of the number of connected filaments or connected lamps. The number of associated filaments thus does not have any influence on the closed-loop control. It is thus possible for a manipulated variable to be determined by means of the information of an operational parameter of only a single filament, and this manipulated variable is used for the open-loop control of the additional heating of a relatively large number of filaments which are all connected outside the control loop.

Provision may be made for the heating power of the filament subjected to closed-loop control to be detected as the operational parameter of this filament subjected to closed-loop control. Provision may furthermore be made for the determined manipulated variable to be transmitted to the first filament via a first actuating element and to the second filament via a second actuating element. In one advantageous refinement, the detected operational parameter of the first filament is transmitted to a heating controller, and the manipulated variable is determined by means of the heating controller.

An apparatus according to the invention for the closed-loop and open-loop control of filament heating for a lamp, in particular for a fluorescent lamp, has a control loop. In this control loop, a first filament, means for detecting an operational parameter of this first filament and means for generating a manipulated variable for the closed-loop control of this first filament are connected. Furthermore, the apparatus according to the invention comprises a second filament, which is arranged outside the control loop or is connected into the apparatus outside the control loop. This second filament can be subjected to open-loop control by means of the manipulated variable determined by the control loop. The invention enables provision of an apparatus which makes possible additional heating of the filaments for a lamp with little complexity.

The control loop preferably comprises a detection element for the purpose of detecting an operational parameter of the first filament and a first actuating element, the first actuating element and the detection element being electrically connected to the first filament. In one advantageous embodiment, a heating controller is connected into the control loop between the detection element and the first actuating element. In addition, provision may be made for the at least second filament to be electrically connected to the first actuating element or a second actuating element. Provision may also be made for the heating controller to be electrically connected to the first actuating element and the second actuating element.

It has proven to be particularly preferable if the apparatus for the closed-loop and open-loop control of filament heating, or an advantageous embodiment thereof, is used as a ballast for lamps. It is particularly suitable when used as a dimmable ballast for lamps, in particular fluorescent lamps.

BRIEF DESCRIPTION OF THE DRAWINGS

One exemplary embodiment of the invention will be explained in more detail below with reference to a schematic drawing. The single FIGURE shows an apparatus according to the invention for the closed-loop and open-loop control of filament heating for fluorescent lamps, which is used as a ballast for fluorescent lamps.

DETAILED DESCRIPTION OF THE INVENTION

The figure illustrates a first filament W1 which serves the purpose of heating a lamp which is in the form of a fluorescent lamp L1 in the exemplary embodiment. The filament W1 is electrically connected at a first end to the fluorescent lamp L1. Furthermore, the first filament W1 is electrically connected at a second end to a first actuating element S1. In addition, a detection element E is shown in the figure. The detection element E in the exemplary embodiment is designed such tat an operational parameter of the first filament W1 can be detected. The detection element E is electrically connected to a heating controller H. Furthermore, the heating controller H in the exemplary embodiment is electrically connected to the actuating element S1, In the exemplary embodiment shown in the figure, the control loop is formed by the first filament W1, the detection element E, the heating controller H and the first actuating element S1 as the essential elements.

As can further be seen in the exemplary embodiment shown in the figure, a second filament W2 is electrically connected to the fluorescent lamp L1 at a first end and to a second actuating element S2 at a second end. Furthermore, filaments W3 to Wn are electrically connected to the second actuating element S2 and lamps L2 to Ln. In the exemplary embodiment, an electrical connection between the heating controller H and the second actuating element S2 is also formed.

Provision may also be made for the second actuating element S2 not to be provided and for the filaments W2 to Wn to be electrically connected to the first actuating element S1. It should be noted that the filaments W2 to Wn are arranged outside the control loop or are connected into the apparatus according to the invention outside the control loop, as illustrated in the figure.

Provision may also be made for the detection element E to be electrically connected to another filament, for example to the filament W2. In this case, the circuit arrangement of the apparatus would need to be designed such that, instead of the first filament W1, the second filament W2 is arranged in the control loop. However, provision may also be made for two or more filaments to be electrically connected to the detection element E and to be connected into a corresponding control loop. In such an exemplary embodiment, the operational parameters of two or more filaments are detected, and a corresponding manipulated variable is determined by the heating controller H from the corresponding information of these operational parameters of the two or more filaments. The actuating element S1 and the actuating element S2 are in the form of voltage sources with duty ratio change, in the exemplary embodiment.

The method according to the invention for the closed-loop and open-loop control of the filament heating will be explained in more detail below. An operational parameter of the first filament W1, which in the exemplary embodiment is the heating power of this first filament W1, is detected by means of the detection element E. The detected heating power is transmitted to the heating controller H as a controlled variable R. A corresponding power detection is carried out by means of the heating controller H. Furthermore, the heating controller H determines a manipulated variable SG on the basis of the obtained controlled variable R, and this manipulated variable SG is transmitted to the first actuating element S1 and to the second actuating element S2. The manipulated variable SG is a signal which contains a duty ratio as the information. By the first actuating element S1 and the second actuating element S2 being in the form of voltage sources with duty ratio change in the exemplary embodiment, the duty ratio of the actuating elements S1 and S2 can be changed by means of the transmitted manipulated variable SG. Owing to the transmission of this manipulated variable SG to the first actuating element S1, a duty ratio change is carried out and, owing to the duty ratio change of the voltage source or of the first actuating element S1, closed-loop control of the first filament W1 is carried out. Furthermore, owing to the transmission of this manipulated variable SG to the second actuating element S2 or to this second voltage source with duty ratio change, a change to this duty ratio is also achieved there. Correspondingly, the filaments W2 to Wn are controlled by means of the second actuating element S2. It is thus possible, by the detection of an operational parameter of a single filament, in the exemplary embodiment of the first filament W1, for a controlled variable R and, on the basis of this, a manipulated variable SG to be generated by means of which, on the one hand, this first filament W1 is subjected to closed-loop control and, on the other hand, additional filaments W2 to Wn, which are not connected into the control loop, but are arranged or connected in the apparatus, are subjected to open-loop control.

The closed-loop control of the additional heating of filaments, which is required in particular in the case of dimmable fluorescent lamps since a reduction in the discharge current and, as a result of this, a reduction in the heating of the filaments occurs during dimming, takes place according to the invention using a single filament W1. However, provision may also be made for the closed-loop control of the additional heating to be carded out using at least two filaments which are connected into the control loop. Owing to the fact that the manipulated variable SG is also fed to the actuating elements which are not arranged in the control loop, the heating of those filaments which are arranged outside the control loop in the apparatus is also carded out corresponding to that for the filaments subjected to closed-loop control. It should be pointed out that a change in the number of lamps in the figure is independent of the closed-loop control of the heating. This means that the closed-loop control operation is not affected by the number of lamps even when this number is changed, for example increased. A change to the number of lamps thus does not lead to any change in the additional heating. All of the filaments can be operated optimally since the number of associated filaments has not influence on the closed-loop control. The principle according to the invention is independent of the type of resonant circuit (s) or independent of the type of discharge current generation. The apparatus according to the invention of filament heating with mixed closed-loop and open-loop control is preferably used as a dimmable ballast for fluorescent lamps.

The invention claimed is:

1. A method for the closed-loop and open-loop control of filament heating for a number of lamps (L1 to Ln), the method comprising the steps of:

a) detecting an operational parameter of at least a first filament (W1), wherein the first filament is arranged in a control loop;

b) determining a manipulated variable (SG) on the basis of the detected operational parameter;

c) providing, on the basis of the manipulated variable, closed-loop control of the first filament (W1) and open-loop control of at least a second filament (W2 to Wn), wherein the second filament (W2 to Wn) is arranged outside the control loop; and wherein the steps of detecting the operational parameter and of determining the manipulated variable (SG) are carried out independently of the number of filaments (W1 to Wn) and the number of lamps (L1 to Ln) which are electrically connected to the filaments (W1 to Wn).

2. The method as claimed in claim 1, characterized in that the heating power of the first filament (W1) is detected as the operational parameter.

3. A method for the closed-loop and open-loop control of filament heating for lamps, the method comprising the steps of:

a) detecting an operational parameter of at least a first filament (W1), wherein the first filament is arranged in a control loop;

b) determining a manipulated variable (SG) on a basis of the detected operational parameter;

c) providing, on a basis of the manipulated variable, closed-loop control of the first filament (W1) and open-loop control of at least a second filament (W2 to Wn), wherein the second filament (W2 to Wn) is arranged outside the control loop; and wherein heating power of the first filament (W1) is detected as the operational parameter.

4. An apparatus for the closed-loop and open-loop control of filament heating for a lamp, the apparatus comprising:

a control loop which has at least a first filament (W1), means for detecting an operational parameter of the first filament (W1) and means for generating a manipulated variable (SG) for the closed-loop control of the first filament (W1);

at least a second filament (W2 to Wn), which is outside the control loop and which is subjected to open-loop control by means of the manipulated variable (SG) determined by the control loop; and wherein the control loop has a detection element (E) for the purpose of detecting the operational parameter of the first filament (W1), and a first actuating element (S1), wherein the first actuating element (S1) and the detection element (E) are electrically connected to the first filament (W1).

5. The apparatus as claimed in claim 4, further comprising a second actuating element (S2), wherein the first actuating element (S1) and the second actuating element (S2) are in the form of voltage sources with duty ratio change.

6. The apparatus as claimed in claim 4, further comprising a heating controller (H) that is connected into the control loop between the detection element (E) and the first actuating element (S1).

* * * * *